United States Patent [19]

Artzt et al.

[11] 4,083,173

[45] Apr. 11, 1978

[54] METHOD AND APPARATUS FOR THE MANUFACTURE OF CORE YARN IN AN OPEN-END SPINNING DEVICE

[75] Inventors: Peter Artzt, Reutlingen; Albert Bausch, Melchingen; Gerhard Egbers, Eningen, all of Germany

[73] Assignee: Schubert & Salzer Maschinenfabrik Aktiengesellschaft, Ingolstadt, Germany

[21] Appl. No.: 682,744

[22] Filed: May 3, 1976

Related U.S. Application Data

[63] Continuation of Ser. No. 531,872, Dec. 12, 1974, abandoned.

[30] Foreign Application Priority Data

Dec. 22, 1973 Germany ..... 2364230

[51] Int. Cl.[2] ..... D01H 1/12; D02G 3/38

[52] U.S. Cl. ..... 57/58.95; 57/5; 57/160

[58] Field of Search ..... 57/5, 12, 58.89, 58.95, 57/160

[56] References Cited

U.S. PATENT DOCUMENTS

| | | | |
|---|---|---|---|
| 3,445,993 | 5/1969 | Vorisek | 57/58.95 X |
| 3,605,395 | 9/1971 | Morikawa et al. | 57/58.95 X |

*Primary Examiner*—Richard C. Queisser
*Assistant Examiner*—Charles Gorenstein
*Attorney, Agent, or Firm*—Robert W. Beach; R. M. Van Winkle; Ward Brown

[57] ABSTRACT

A core thread is combined with staple fiber in a spinning rotor by feeding the core thread to form a loop in the fiber collection surface while feeding and withdrawing the core thread in a manner to maintain it substantially linear, and the stable fiber is spun into an outer yarn shroud twisted about the axis of the core thread. The core thread feed tube is located at one side of and spaced from a diametral plane through the fiber collection surface, and the fiber feed tube is located at the opposite side of and spaced from such plane through the fiber collection surface. A loop is formed in the core thread by delaying startup of drawoff rollers for a predetermined interval after startup of core thread supply rollers, and the loop is laid on the circumference of the fiber collection surface by rotation of the spinning rotor. The rate of core yarn drawoff is determined by the rate of core thread feed less an allowance for a slight shortening of the core thread during twisting of staple fiber onto the core thread.

12 Claims, 1 Drawing Figure

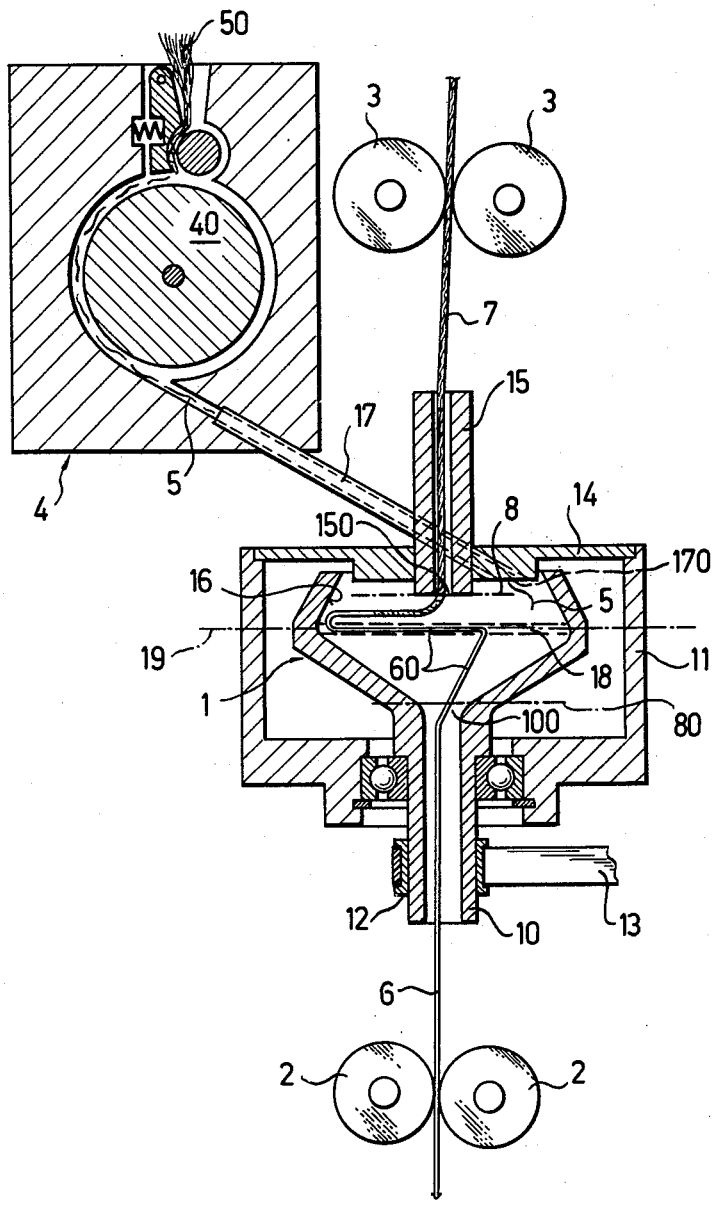
50
3
3
40
7
15
17
5
4
150
8
14
170
16
5
19
60
18
11
1
100
80
12
10
13
6
2
2

METHOD AND APPARATUS FOR THE MANUFACTURE OF CORE YARN IN AN OPEN-END SPINNING DEVICE

This is a continuation of application Ser. No. 531,872, filed Dec. 12, 1974 now abandoned.

BACKGROUND OF THE INVENTION

1. Field of the Invention

The present invention relates to a method and apparatus for manufacturing core yarn in the spinning rotor and an open end spinning machine in which staple fibers are fed to the rotor collection surface and are twisted around the axis of a core thread to form a core yarn having a substantially linear core.

2. Prior Art

Attempts to develop methods for production of a core yarn by spinning staple fibers onto a core thread using an open-end spinning machine have produced satisfactory results for some purposes, but either it has not been possible to obtain a high quality of spun yarn or the core thread has been twisted together with the fiber ring to form a sort of two-ply yarn instead of the fiber ring being twisted about the axis of a substantially linear core thread.

There have been a number of publications teaching use of a spinning rotor in which a core thread is carried axially through the rotor, and a staple fiber yarn formed from fibers supplied to the rotor fiber collection surface is thrown around the axially disposed core thread U.S. Pat. No. 3,445,993, JA No. 29,453/71, DL No. 88,001). The product of this process is a kind of twine having a stretched core thread and a helical staple fiber yarn wound around it, such as shown in FIG. 5 of U.S. Pat. No. 3,605,395.

The disclosure of U.S. Pat. No. 3,605,395 also teaches a process for guiding a core thread through the spinning rotor with sufficient slack to form a loop adjacent to the fiber collection surface whereby the core thread and the staple fiber yarn are entwined on the inside wall of the spinning rotor. In this case, both the core thread and the fiber yarn are twisted together and produce a yarn resembling a two-ply yarn.

SUMMARY OF THE INVENTION

It is the principal object of the present invention to provide a method and apparatus by which a core yarn is produced in an open-end spinning device having a central, substantially linear core thread and an outer covering of spun fibers twisted onto the core thread.

The foregoing object can be accomplished by supplying a core thread concentrically through the spinning rotor, diverting a stretch of the concentric thread to the fiber collection surface to lie along a circumferential portion of the collection surface and twisting the fibers located on the collection surface about the axis of the core thread. In accordance with a further characteristic of the present invention, the core thread is supplied to the spinning rotor at one speed and the core yarn formed in the rotor is drawn off at a lower speed, the difference in the supply and drawoff speeds corresponding to the extent to which the core thread is shortened by twisting of the fibers onto it.

Apparatus for performing this process includes a supply tube for the core thread having its outfeed end located within the spinning rotor, a fiber feed tube emptying into the spinning rotor and a yarn drawoff tube having its infeed end in the spinning rotor. Each of these tube ends terminates on a rotor diametral plane spaced from the diametral plane through the fiber collection surface. In accordance with a further feature of the present invention, the fiber feed tube and the core thread supply tube are located at opposite sides of the fiber collection surface diametral plane, and the core thread supply tube may be carried in the hollow rotor shaft or the shaft itself may serve as the supply tube.

With the method and apparatus of the present invention, a high density core yarn can be produced in which relative slippage or shifting of the core thread and the fiber covering is eliminated because the core thread is completely and concentrically wrapped by spun fibers. In addition, the quantity or rate of delivery of the core thread can be changed relative to a constant rate of fiber supply to produce yarn of various characteristics.

DRAWING

The drawing is a section through an open-end spinning device taken axially of the spinning rotor and showing the apparatus of the present invention.

DETAILED DESCRIPTION

The spinning rotor 1 includes a hollow shaft 10 which is journaled in rotor housing 11. The conventional drive for the spinning rotor includes a sheave 12 on shaft 10 rotated by a drive belt 13. The housing 11 is closed by a cover 14 which carries a tube 15 extending through the cover and disposed concentrically of the rotor axis. A fiber supply channel 17 also extends through cover 14 and is disposed with its outfeed end directed toward the inner wall 16 of rotor 1. The fiber collection surface 18 of the representative spinning rotor shown is located axially of the rotor at the location of greatest interior diameter.

Pairs of rollers 2 and 3 respectively are located adjacent to the ends of rotor shaft 10 and tube 15 which extend outside of the housing 11. A conventional sliver resolving device 4 is located at the outer end of tube 17 for supplying fibers 5 resolved from sliver 50 to the feed tube 17. The form of resolving device shown for purposes of illustration includes an opening roller 40 for stripping fibers 5 from sliver 50. Alternatively, a drafting type of resolving device could be used.

Rollers 2 supply a core thread 6 without slippage for passage through the hollow shaft 10 into the interior of the spinning rotor 1, shaft 10 serving as a core thread supply tube. The core thread extends continuously from rollers 2 through the spinning rotor to rollers 3 by which it is drawn as part of finished yarn 7 from the spinning rotor. As the spinning operation is begun, there is a time delay after startup of rollers 2 before rollers 3 are started for drawing off the yarn. The time delay is phased precisely to permit a particular degree of slack in core thread 6 between the roller pairs 2 and 3 so that the centrifugal force in the spinning rotor forms a loop 60 which extends from the core thread supply tube 10 to the fiber collection surface 18 and then to the drawoff tube 15. The loop 60 is sufficiently large so that a stretch of core thread 6 lies along the fiber collection surface over a definite circumferential extent of the fiber collection surface 18. However, the stretch of loop 60 lying along the collection surface must be no longer than the circumference of collection surface 18 in order to prevent twisting of the core thread into a two-ply kind of formation with the staple fiber band. The time delay between startup of rollers 2 and 3 can be calculated from the radius of the spinning rotor collection surface after the desired circumferential extent of loop 60 has been selected.

Highspeed rotation of rotor shaft supply tube 10 and the rotor 1 effects a false twist in the core thread 6, but the core thread rotates back again when it leaves the fiber collection surface 18. As the core thread turns back about its own axis, fibers 5 which were supplied through feed tube 17 over rotor inner wall 16 to collection surface 18 are twisted onto the core thread. The resulting yarn 7 has a substantially linear core thread 6 shrouded by fibers 5 which have been spun together. Because of the twisting in of fibers 5 after they have been deposited on the core thread 6, the core thread is slightly shortened by this twisting process. In order to permit the formation of a loop 60 and the deposition of such loop 60 along the collection surface 18, to prevent shortening of the loop 60 and its eventual separation from the collection surface 18, the drawoff speed of rollers 3 must be synchronized with the delivery speed of rollers 2 to compensate for such shortening of the core thread.

When sufficient fibers are supplied so that the core thread 6 is completely spun, the staple fiber component of the yarn 7 has a true twist.

It is essential in the apparatus of the present invention that both the outfeed edn 100 of core thread supply tube 10 and the infeed end of the yarn drawoff tube 15 are spaced substantially from the diametral plane 19 through the fiber collection surface. Dot-dash lines 80 and 8 respectively represent diametral planes of the rotor at which the inner ends of supply tube 10 and drawoff tube 15 terminate. Such spacing is necessary in order to effect the initial false twist in the core thread 6, to permit formation of a fiber covering on the loop 60 and to effect the back rotation of the core thread and twisting in of the fibers.

In the example shown in the drawing, the core thread supply tube is formed by the rotor hollow shaft 10, and the yarn drawoff tube is formed by the tube 15 extending through the housing cover 14 so, with relation to the spinning location indicated by dot-dash line 19 representing a rotor diametral plane through the fiber collection surface, the outfeed end 170 of the fiber feed tube 17 and the outfeed end 100 of the core thread supply tube are located at opposite sides of each rotor diametral plane. It is, however, possible to arrange the apparatus for production of core yarn according to the present invention so that the tube 15 forms the core thread supply tube and the yarn drawoff tube is formed by the hollow rotor shaft 10, in which case rollers 3 are the supply rollers and rollers 2 are the lower speed drawoff rollers. Instead of having the hollow shaft 10 itself form the walls of the supply or drawoff tube, a tubular insert could be mounted in the hollow shaft 10, either for conjoint rotation or relative rotation, including such tube insert being stationary. Rotation of such a tube insert could be effected by the drive 12, 13 for spinning rotor 1 or could be driven by independent drive means.

Using the method of the present invention, a wide variety of core yarns can be produced. For example, the core thread could be any kind of yarn, such as an endless single-ply or multiple-ply yarn. By use of various core thread supply tube arrangements, such as the hollow shaft inserts suggested above, the core thread during its feed to the spinning rotor 1 could be run in with or without twists. The core thread 6 may be textured or untextured, knopped or unknopped. If it consists of several individual threads, such threads can be of various cross-sectional forms. It would also be possible to form the core thread 6 in a continuous operation with formation of the core yarn 7 by arranging a core thread spinning rotor in axial tandem with the core yarn spinning rotor, in which case feed rollers 2 for the yarn spinning rotor could, for example, constitute drawoff rollers for the core thread-producing spinning rotor.

We claim:

1. A method for manufacturing a core yarn in an open-end spinning device having a spinning rotor, a fiber collection surface in the spinning rotor disposed circumferentially thereof, fiber feed means supplying fibers to the collection surface and a core thread supplied to the spinning rotor axially thereof and receiving fibers supplied to the rotor, which method comprises the steps of diverting the core thread from its axial path, forming a loop in the core thread, laying a portion of such loop along a substantial circumferential portion of the collection surface, and twisting fibers supplied to such collection surface around the axis of the core thread portion lying on the collection surface.

2. The method defined in claim 1, and the steps of supplying the core thread to the spinning rotor at one speed, and drawing off the yarn from the spinning rotor at a different slower speed to compensate for shortening of the core thread during twisting of the fibers therearound.

3. An open-end spinning device having a spinning rotor including a circumferential fiber collection surface at the location of the greatest interior diameter of the rotor and a drive shaft, a core thread supply tube, a fiber feed tube and a yarn drawoff tube, each of such tubes having an inner end projecting into the spinning rotor, the improvement comprising the inner end of the core thread supply tube and the inner end of the yarn drawoff tube being spaced, respectively, a substantial distance from a diametral plane through the fiber collection surface, the yarn drawoff tube inner end and the core thread supply tube inner end being disposed at opposite sides of said collection surface diametral plane so that an initial false twist can be imparted to core thread supplied through the core thread supply tube.

4. The spinning device defined in claim 3, the improvement further comprising the fiber feed tube inner end and the core thread supply tube inner end being disposed at opposite sides of the collection surface diametral plane.

5. The spinning device defined in claim 3, the improvement further comprising means for supplying core thread to the spinning rotor through the core thread supply tube, means for feeding fibers to the spinning rotor through the fiber feed tube to be twisted around the core thread to form core yarn, and means for drawing off yarn from the spinning rotor, said core thread supply means operating at one speed and said yarn drawoff means operating at a different slower speed to compensate for shortening of the core thread during twisting of fibers therearound.

6. An open-end spinning device having a spinning rotor including a circumferential fiber collection surface at the location of the greatest interior diameter of the rotor and a drive shaft, a core thread supply tube, a fiber feed tube and a yarn drawoff tube, each of such tubes having an inner end projecting into the spinning rotor, the improvement comprising the spinning rotor drive shaft being hollow and forming the core thread supply tube, the core thread supply tube rotating conjointly with such drive shaft, the inner end of the core thread supply tube and the inner end of the yarn drawoff tube being spaced, respectively, a substantial distance from a diametral plane through the fiber collection surface, and the yarn drawoff tube inner end and the core thread supply tube inner end being disposed at opposite sides of said collection surface diametral plane.

7. The spinning device defined in claim 6, the improvement further comprising the fiber feed tube inner end and the core thread supply tube inner end being disposed at opposite sides of the collection surface diametral plane.

8. The spinning device defined in claim 6, the improvement further comprising means for supplying core thread to the spinning rotor through the core thread supply tube, means for feeding fibers to the spinning rotor through the fiber feed tube to be twisted around the core thread to form core yarn, and means for drawing off yarn from the spinning rotor, said core thread supply means operating at one speed and said yarn drawoff means operating at a different slower speed to compensate for shortening of the core thread during twisting of fibers therearound.

9. A method for manufacturing a core yarn in an open-end spinning device having a spinning rotor, a fiber collection surface in the spinning rotor disposed circumferentially thereof, fiber feed means supply fibers to the collection surface and a core thread supplied to the spinning rotor axially thereof and receiving fibers supplied to the rotor, which method comprises the steps of imparting an initial false twist to the core thread, diverting the false twisted core thread from its axial path to a circumferential portion of the collection surface, and twisting fibers supplied to such collection surface around the axis of the core thread portion at the collection surface.

10. The method defined in claim 9, and the steps of supplying the core thread to the spinning rotor at one speed, and drawing off the yarn from the spinning rotor at a different slower speed to compensate for shortening of the core thread during twisting of the fibers therearound.

11. A method for manufacturing a core yarn in an open-end spinning device having a spinning rotor, a fiber collection surface in the spinning rotor disposed circumferentially thereof, fiber feed means supplying fibers to the collection surface and the core thread supplied to the spinning rotor axially thereof and receiving fibers supplied to the rotor, which method comprises the steps of imparting an initial false twist to the core thread, wrapping fibers from the collection surface around the core thread, and retwisting the core thread to form a core yarn.

12. The method defined in claim 11, and the steps of supplying the core thread to the spinning rotor at one speed, and drawing off the yarn from the spinning rotor at a different slower speed to compensate for shortening of the core thread during twisting of the fibers therearound.

* * * * *

UNITED STATES PATENT OFFICE

CERTIFICATE OF CORRECTION

Patent No. 4,083,173 Dated April 11, 1978

Inventor(s) Peter Artzt, Albert Bausch and Gerhard Egbers

It is certified that error appears in the above-identified patent and that said Letters Patent are hereby corrected as shown below:

Title page, Section [57] Abstract, line 5, cancel "stable" and insert --staple--.

Column 1, line 59, after "invention,", insert --an initial false twist is imparted to the core thread, then fibers from the collection surface are wrapped around the core thread and then the core thread is retwisted to form a core yarn. Another feature is that--.

Column 2, line 5, cancel "fiber feed" and insert --yarn drawoff--.

Column 5, line 28, cancel "supply" and insert --supplying--.

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*